US005209034A

United States Patent [19]

Box et al.

[11] Patent Number: 5,209,034

[45] Date of Patent: May 11, 1993

[54] PREVENTION OF FOGGING AND DISCOLORATION OF MULTI-PANE WINDOWS

[75] Inventors: James A. Box, Broadview Heights; Thomas W. Greenlee, Shaker Heights; Lori A. Postak, Cleveland Heights, all of Ohio

[73] Assignee: Tremco, Inc., Beachwood, Ohio

[21] Appl. No.: 628,882

[22] Filed: Dec. 18, 1990

[51] Int. Cl.[5] ..... E06B 7/12

[52] U.S. Cl. ..... 52/171; 52/788; 52/790

[58] Field of Search ..... 52/171, 172, 788, 790; 106/803, 811

[56] References Cited

U.S. PATENT DOCUMENTS 4,278,468 7/1981 Selbe et al. ..... 106/111

5,007,217 4/1991 Glover et al. ..... 52/172

*Primary Examiner*—Richard E. Chilcot, Jr.

*Assistant Examiner*—Matthew E. Leno

*Attorney, Agent, or Firm*—Konrad H. Kaeding; David P. Dureska

[57] ABSTRACT

Fogging and discoloration of multi-pane windows is prevented by sealing the windows with a polymeric seal and by sorbing off-gases evolved by the seal through the use of diatomaceous earth. The diatomaceous earth can be disposed within the volume defined by the panes and the seal, preferably by being disposed within a hollow spacer, or the diatomaceous earth can be mixed with the seal itself. If the diatomaceous earth is mixed with the seal, it can constitute about 1–15 percent by volume of the seal, preferably 1–2 percent by volume. Diatomaceous earth has been found to be especially effective in preventing fogging and discoloration of low emissivity glass.

21 Claims, 4 Drawing Sheets

PREVENTION OF FOGGING AND DISCOLORATION OF MULTI-PANE WINDOWS

1. FIELD OF THE INVENTION

The invention relates to the prevention of fogging and discoloration of multi-pane windows and, more particularly, to the addition of a scavenger to multi-pane window seals or spacers to sorb off-gases evolved by the seal.

2. BACKGROUND OF THE INVENTION

Multi-pane windows have been widely used as a means for decreasing heat loss in residences and other buildings. Such multi-pane windows usually are constructed by joining two single-pane windows together with a seal made of a polymeric material such as polysulfide, butyl, or polyisobutylene. A metal spacer typically is disposed intermediate the panes about the periphery thereof in order to maintain a desired spacing of the panes. Frequently, the spacer will be coated by a portion of the seal or will be disposed within the seal so as to perform a combined spacing/sealing function.

A problem exists with sealed multi-pane windows in that fogging of the window panes can occur. That is, moisture trapped in the volume defined by the spaced, sealed panes can condense on the panes, thereby fogging the panes and reducing light transmissibility. This type of fogging is known as aqueous fogging because it is caused by the water content of the atmosphere within the sealed volume.

A second type of fogging, known as chemical fogging, relates to the type of material used to seal the window panes. The seal material typically is a high molecular weight polymer that generates, or releases, solvents such as toluene or xylene, or volatile organic oligomers, by-products, degradation products, processing aides, tackifier resins, plasticizers or the like. These so-called off-gases will migrate into the volume defined by the spaced panes; the off-gases can condense on the window panes so as to produce fogging or discoloration of the panes.

Chemical fogging can be particularly acute with low emissivity glass. Low emissivity glass is glass that has been treated on its inner surface with various metal oxides and metals in order to reduce the emissivity of the glass. A typical coating for low emissivity glass includes layers of iridium oxide and elemental silver, as well as an additional layer of iridium oxide (or zinc oxide or titanium oxide).

Various techniques have been used in an attempt to solve the problem of chemical fogging. It has been known to use adsorbents inside the volume defined by the sealed window panes in order to prevent aqueous fogging and chemical fogging. The adsorbents have been mixed directly into the seal, or the adsorbents have been disposed within the spacers (where the spacers are hollow). Adsorbents that have been used include silica gel, carbon black, and various molecular sieves, such as MOLSIV adsorbent, commercially available from the Union Carbide Corporation, Tarrytown, New York 10591. While such adsorbents have been effective in preventing fogging of clear glass, they are generally ineffective in preventing chemical fogging of low emissivity glass.

Desirably, a technique would be available that would prevent chemical fogging of low emissivity glass. The technique desirably would be inexpensive, easy to install, and effective throughout the expected life of the window.

SUMMARY OF THE INVENTION

The present invention provides a new and improved method for preventing fogging and discoloration of multi-pane windows, particularly low emissivity windows. In the preferred embodiment of the invention, a scavenger is provided for attracting, and sorbing, low molecular weight off-gases evolved by the high molecular weight polymer seal. Preferably, the scavenger is diatomite (also known as diatomaceous earth or kieselguhr), a sedimentary rock of marine or lacustrine deposition. Diatomaceous earth is a readily available, inexpensive, chalk-like sediment made up of fragments and shells of diatoms. Diatomaceous earth has high porosity, low density, and great surface area. Surprisingly, diatomaceous earth has been found to function more effectively as a scavenger than prior known adsorbents such as silica gels, molecular sieves, or any other known adsorbent.

Diatomaceous earth can be used with known seals and spacers in the same manner as adsorbents heretofore have been used. That is, diatomaceous earth can be incorporated into the seal itself, or it can be disposed within a hollow spacer. Diatomaceous earth has been found to be particularly effective when incorporated in a polyisobutylene seal. Up to 10%–15% by weight of diatomaceous earth can be used, although 1%–3% by weight is preferred.

While it is not known for certain how the invention operates, it is believed that the surface configuration of the diatomaceous earth particles plays an important role in scavenging the low molecular weight off-gases. The surfaces of the diatomaceous earth particles are configured such that small recesses, or chambers, are formed. It is believed that molecules of the off-gases migrate into the chambers where they are retained. It also is believed that the surface configuration of other adsorbents such as silica gels is inadequate for that purpose. Tests have shown that diatomaceous earth not only preferentially binds low molecular weight off-gases better than silica gels, but it also is slower in releasing bound off-gases than silica gels.

In addition to this mechanical adsorption theory, diatomaceous earth may benefit from a molecular structure (expressed as $SiO_2$), that permits it to selectively sorb molecules based on their electrical charge. Since the diatomaceous earth is comprised of a substantially amorphous silicon dioxide structure, it can be theorized that diatomaceous earth, unlike silica gels and molecular sieves, has less natural affinity for polar molecules. Both silica gels and molecular sieves have suffered from the fact that water tends to saturate the available binding sites within these substances to the exclusion of certain hydrocarbons that desirably might be removed.

Although processes designed to increase the hydrophobicity of silica gels and molecular sieves have been developed, such hydrophobic silica gels and molecular sieves have been unsuccessful in completely preventing chemical fogging of low emissivity glass. It is believed that diatomaceous earth may have a hydrophobic nature that differs from the manufactured hydrophobicity of the silica gels and molecular sieves. This hydrophobic nature, along with the $SiO_2$ molecular structure of diatomaceous earth, may account for its ability to selectively adsorb certain low molecular weight hydrocarbons without those hydrocarbons being displaced by more polar molecules such as water.

The present invention has a number of important advantages. Perhaps the most important advantage is that diatomaceous earth functions effectively to prevent fogging and discoloration of low emissivity glass, whereas other adsorbents cannot. Diatomaceous earth is inexpensive and it is readily available. Diatomaceous earth can be handled without difficulty, and it can be incorporated into the seal or into the spacers in the same manner as other adsorbents or desiccants. Accordingly, conventional processing equipment can be used to incorporate diatomaceous earth into the window structure.

The foregoing and other features and advantages of the invention are illustrated in the accompanying drawings and are described in more detail in the specification and claims that follow.

DESCRIPTION OF THE PREFERRED EMBODIMENT

Figure 1:
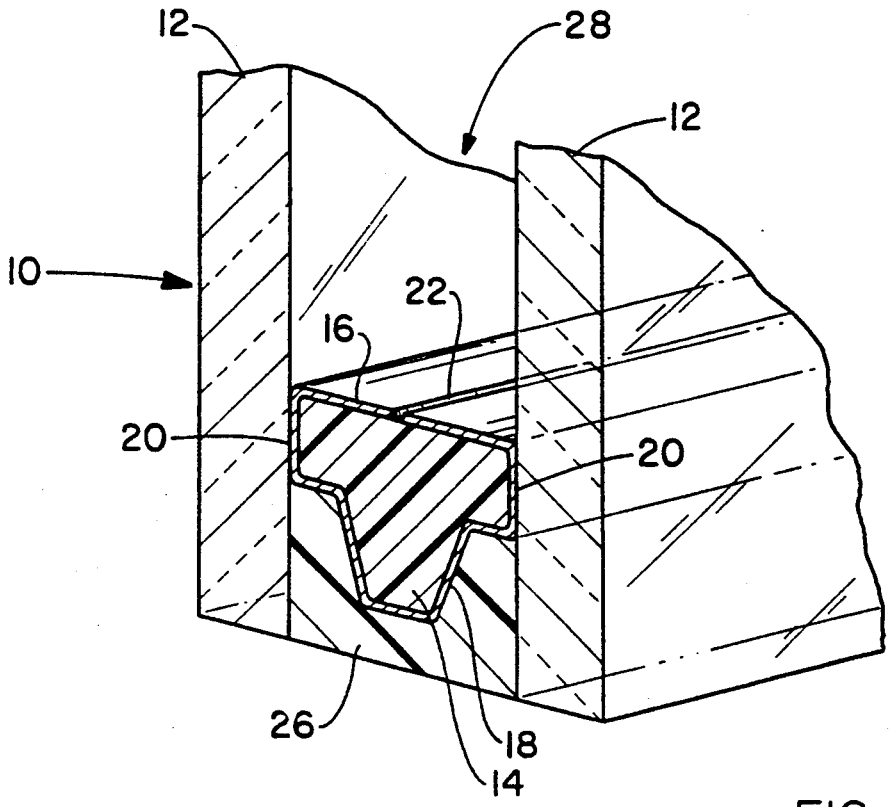
FIG. 1 is a cross-sectional view of a portion of a multi-pane window employing a hollow spacer and a seal.

Referring to FIG. 1, a multi-pane window is indicated generally by the reference numeral 10. The window 10 includes two panes of glass 12 that are disposed parallel to one another. A spacer 14 is disposed intermediate the panes 12 about the periphery of the panes 12. The spacer 14 typically is made of metal such as aluminum or an aluminum alloy, or the spacer can be made of plastic or the like. The spacer 14 includes a flat inner wall 16, a contoured outer wall 18, and opposed, flat sidewalls 20. The sidewalls 20 are in contact with the polymeric seal 38, 40 which in turn are in contact with inner surfaces of the panes 12. A longitudinally extending gap 22 is formed in the inner wall 16. A quantity of adsorbent 24 is disposed within the spacer 14 as defined by the walls 16, 18, 20.

A polymeric seal 26 is disposed intermediate the panes 12 about the outer periphery thereof. The seal 26 is in contact with the panes 12, as well as the outer wall 18. Together, the spacer 14 and the seal 26 keep the panes 12 spaced a desired distance and provide an airtight seal for the panes 12. The interior volume of the window 10 defined by the spaced panes 12 and the peripheral spacer 14 and the seal 26 is indicated in FIG. 1 by the reference numeral 28.

In an alternative embodiment, the spacer strip is composed of a moisture permeable flexible or semi-rigid silicone foam material, preferably preformed to have, when in an uncompressed condition, two opposite sides spaced so as to provide the desired spacing of the glass panes. Such a spacer strip can contain desiccant material and can have a preapplied ultra-violet resitant acrylic pressure sensitive adhesive on the opposite sides thereof. In such an embodiment, an outer sealant filling the outer perimeter channel of the glass panes is recommended.

Figure 2:
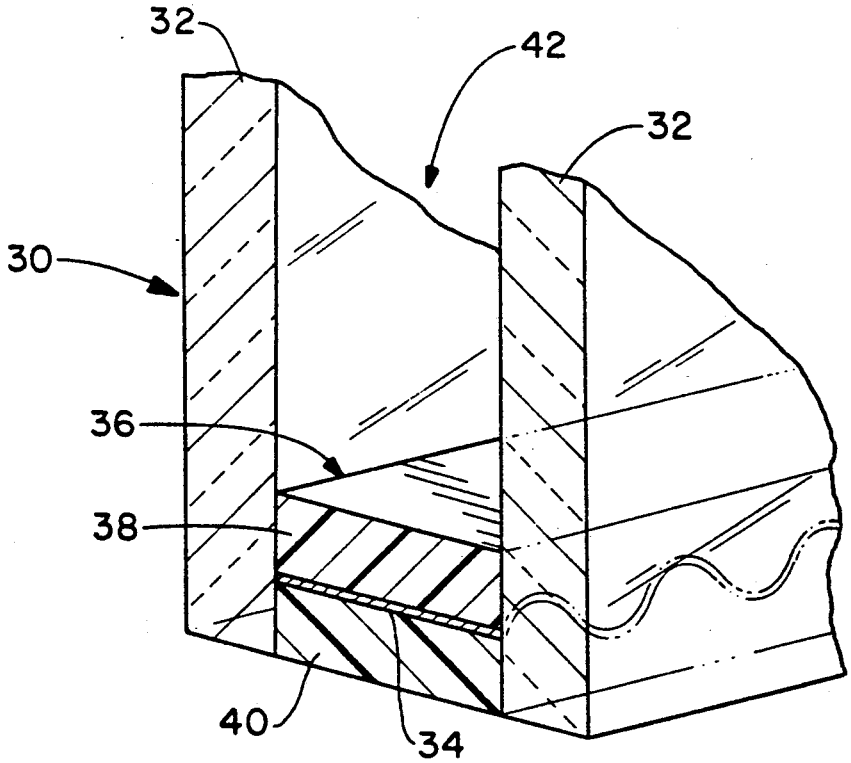
FIG. 2 is a view similar to FIG. 1 showing a spacer disposed within a seal.

Referring to FIG. 2, an alternate window assembly is indicated generally by the reference numeral 30. The window 30 includes two panes of glass 32 that are disposed parallel to one another. A spacer 34 is disposed intermediate the panes 32 about the periphery of the panes 32. The spacer 34 is in the form of a fluted metal strip extending laterally between the panes 32. The spacer 34 typically is about 0.010 inch thick, and usually is made of aluminum or an aluminum alloy.

The spacer 34 is disposed within a polymeric seal 36. The seal 36 includes an inner portion 38 and an outer portion 40. The portions 38, 40 encapsulate the spacer 34. The portions 38, 40 also extend laterally between the panes 32 so as to provide an airtight seal therebetween. The volume defined by the spaced panes 32 and the seal 36 is indicated in FIG. 2 by the reference numeral 42.

The seals 26, 36 can be made from a variety of materials. For example, the seals 26, 36 can be made from polysulfide, various butyls, isoprene, silicone, urethane, or any other flexible seal material commonly used to space and seal multi-pane windows. Suitable seals 26, 36 are commercially available from Tremco Inc., 3735 Green Road, Beachwood, Ohio 44122, under the model designation JS-709, JS-780, JS-802, JS-880, et seq.

Regardless of the material selected for the seals 26, 36, the material must satisfy a variety of requirements unique to sealing multi-pane windows. For example, the seals must have a low moisture vapor transmission (preferably less than 0.2 grams of water per 645 $cm^2$ per 24 hours), excellent adhesion to metal spacers and glass, and resistance to degradation (from ultraviolet light, oxidation, or the like). The seals 26, 36 also must be flexible at low temperatures, have good impact resistance at low temperatures, and have the ability to resist "cold flow."

Although the seals 26, 36 have been found to be well-suited for most applications, a problem has arisen with respect to so-called low emissivity ("low E") glass. Low E glass is glass that has been treated on one surface with various metal oxides and metals in order to reduce the emissivity of the glass. A typical coating for low emissivity glass includes layers of iridium oxide and elemental silver, as well as an additional layer of iridium oxide (or zinc oxide or titanium oxide). The layers usually are applied to a total thickness of about 450 Å. Unfortunately, low E glass has a tendency to become discolored, or fogged.

The seals 26, 36 release organic off-gases that are the cause of chemical fogging. It has been known to use adsorbents 24 disposed within the spacer 14 or an adsorbent (not shown) intimately mixed as part of the seal 36 in order to sorb off-gases, and thereby prevent fogging caused by the off-gases. The adsorbents also have been used as desiccants to remove water vapor that may be sealed within the volumes 28, 42. Typical adsorbents that have been used include silica gels, fumed silica, activated carbon, carbon blacks, activated alumina, and zeolites (molecular sieves). Unfortunately, while such adsorbents have been effective in preventing fogging of clear gas, they have been ineffective in preventing chemical fogging of low E glass.

It has been discovered that if the adsorbent 24 or the adsorbent incorporated as part of the seal 36 is diatomaceous earth, then organic off-gases evolved by the sealant binder can be sorbed, with the consequent result that chemical fogging of low E glass can be prevented. diatomaceous earth, also known as diatomaceous earth or kieselguhr, is a sedimentary rock of marine or lacustrine deposition. Diatomaceous earth is a readily available, inexpensive, chalk-like sediment made up of fragments and shells of diatoms. Diatomaceous earth has high porosity, low density, and great surface area. Diatoms are single-cell aquatic plants whose skeletal remains comprise diatomaceous earth. The complete diatom consists of the living cell itself, encased in and protected by two half-cell walls or valves united by a connecting band.

Figure 3:
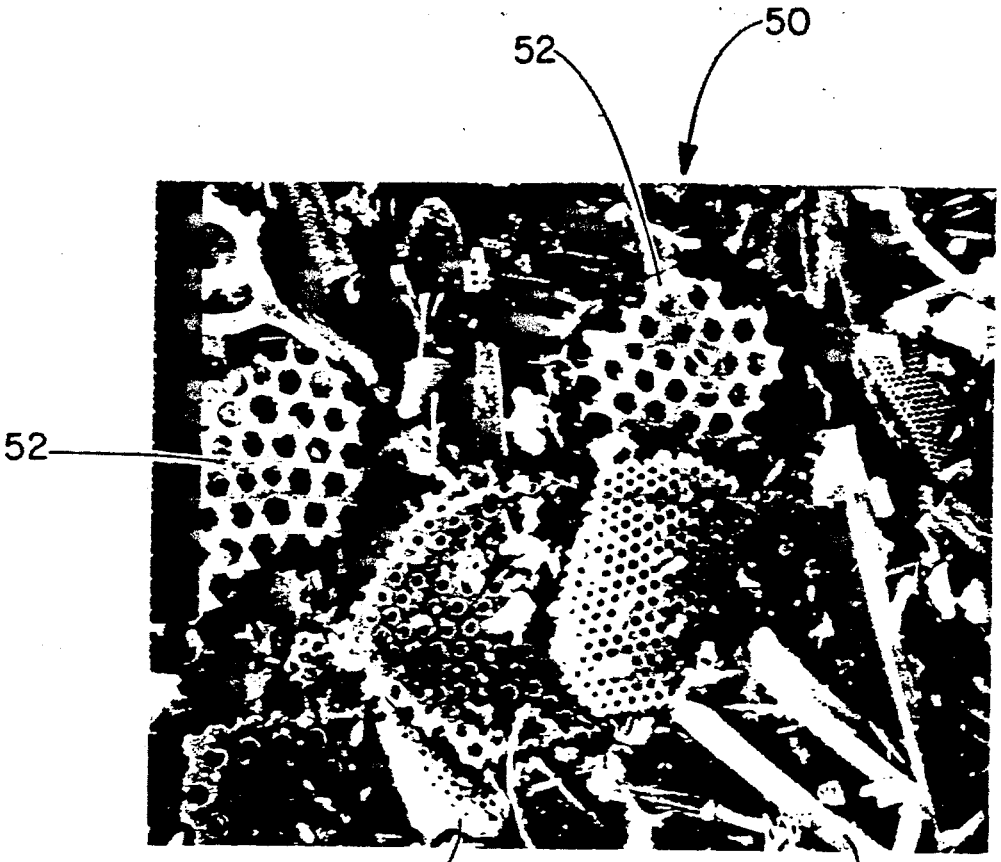
FIG. 3 is a photomicrograph of diatomaceous earth at a magnification of 1,000×.

Referring to FIG. 3, a photomicrograph of diatomaceous earth at a magnification of 1000× is indicated generally by the reference numeral 50. The diatomaceous earth 50 includes individual diatom skeltons 52. The diatoms 52 are all different due to differences in the living cells themselves. It is believed that between 400 and 500 species of diatoms 52 exist.

Figure 4:
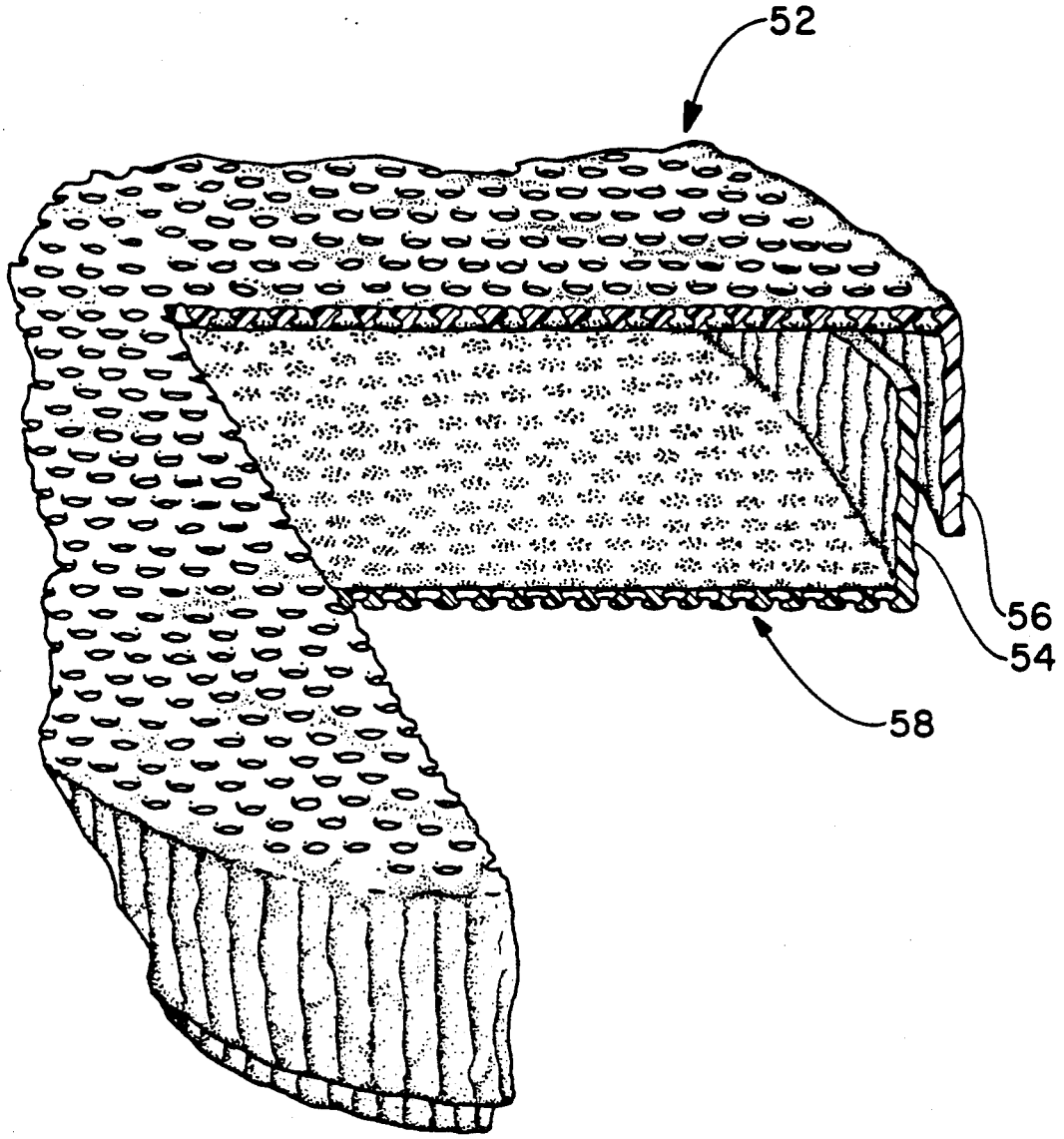
FIG. 4 is an enlarged, sectional view of a so-called "pillbox" form of diatomaceous earth.
Figure 5:
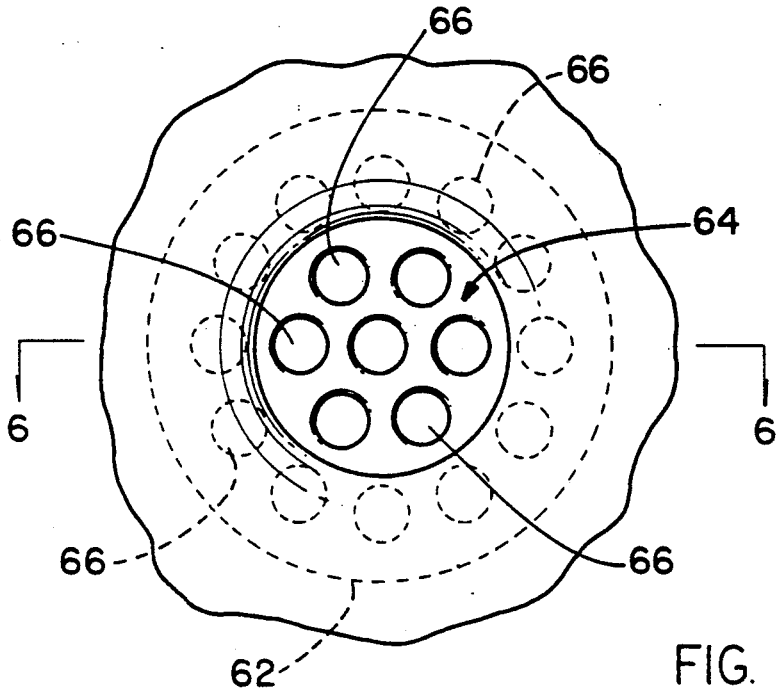
FIG. 5 is a plan view of the pillbox form of diatomaceous earth shown in FIG. 4.
Figure 6:
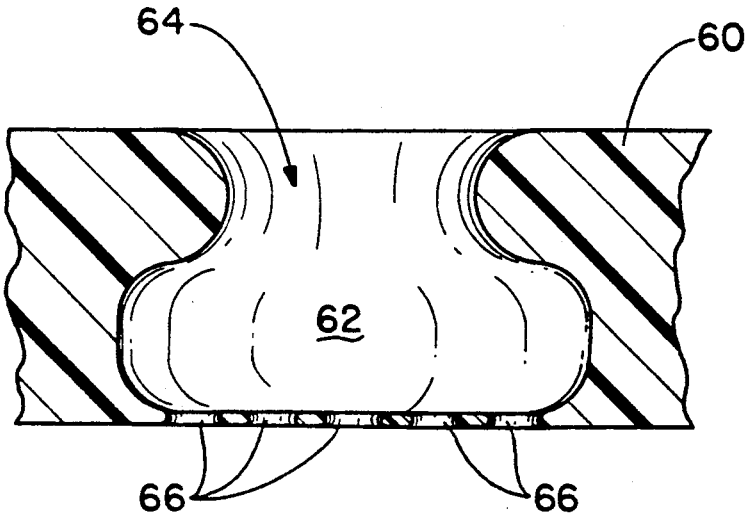
FIG. 6 is a cross-sectional view of the pillbox form of diatomaceous earth shown in FIG. 5, taken along a plane indicated by line 6—6 in FIG. 5.

Referring to FIGS. 4–6, a diatom 52 in typical "pillbox" form is illustrated. The diatom 52 comprises two half-cell walls (valves) 54, 56 that are fitted together. The valve 54 fits within the valve 56. The diatom 52 defined by the valves 54, 56 is hollow so as to define a large interior chamber 58. The walls of the valves 54, 56 are formed of siliceous material and are indicated in FIG. 6 by the reference numeral 60. The wall 60 includes a plurality of small chambers 62 that open into the interior chamber 58 through primary openings 64. Entrance to the chambers 62 from outside the walls 60 is controlled by secondary openings 66.

Average pore size for the primary openings 64 is 94 Å, while the secondary openings 66 average 60 Å in diameter. Diatomaceous earth as a class exhibits a wide range of pore diameters depending on the grade of diatomaceous earth that is used. Even diatomaceous earth of a particular grade is usually characterized only by an overall mean pore diameter. An acceptable diatomaceous earth for purposes of the invention is Celite®, commercially available from the Johns-Manville Corporation, Filtration & Minerals Division, Ken-Caryl Ranch, Denver, Colo. 80217.

It is believed that when the diatomaceous earth 50 is disposed within the spacer 14 or is incorporated as part of the seal 36, low molecular weight off-gases evolved by the seals 26, 36 come into contact with the walls 60. Due to the particular sizes of the chambers 62 and the openings 64, 66, molecules of the off-gases can enter the chambers 62 where they will be retained. It also is possible that molecules of the off-gases will pass through the primary opening 64 and into the interior chamber 58 where they will be retained. In either event, the off-gases will be trapped by so-called mechanical adsorption.

In addition to mechanical adsorption, it is believed that the diatoms 52 also may selectively adsorb certain molecules of the off-gases based in whole or in part upon a charge attraction between silicon and/or oxygen atoms that makes up the $SiO_2$ structure of the diatoms 52. It is believed that the low metal content of the diatoms 52, expecially a low amount of aluminum, is responsible for the enhanced ability of the diatoms 52 to selectively adsorb hydrocarbons without the problem of preferable affinity for water that is found in other sorbants such as alumina or the like. In effect, the diatoms 52 are relatively hydrophobic, thereby permitting them to be used effectively as adsorbents for off-gas oligomers. Because the diatoms 52 will accept water as well as hydrocarbons, the diatoms 52 also function as a desiccant in the environment of the windows 10, 30. Accordingly, use of the diatomaceous earth 50 eliminates chemical fogging of the panes 12, 32.

The diatomaceous earth 50 can be used with all known seals and spacers in the same manner as adsorbents and desiccants heretofore have been used. No special handling or storage requirements are required for the diatomaceous earth 50. Although the diatomaceous earth 50 has been found to be particularly effective when incorporated in a poly- isobutylene seal, it is not limited to use with such a seal material. Up to 10–15% by weight of the diatomaceous earth 50 can be incorporated as part of the seal, although 1–3% is effective and, therefore, is preferred.

Although the invention has been described in its preferred form with a certain degree of particularity, it will be understood that the present disclosure of the preferred embodiment has been made only by way of example and that various changes may be resorted to without departing from the true spirit and scope of the invention as hereinafter claimed. It is intended that the patent shall cover, by suitable expression in the appended claims, whatever features of patentable novelty exist in the invention disclosed.

What is claimed is:

1. In a polymeric window seal that has the tendency to evolve organic off-gases, the improvement comprising:

a scavenger disposed within the seal, the scavenger sorbing the organic off-gases before their evolution from the seal, the scavenger consisting essentially of diatomaceous earth.

2. The window seal of claim 1, wherein the scavenger is disposed uniformly throughout the seal.

3. The window seal of claim 1, wherein the seal is selected from the group consisting of polyisoprene, polysulfide, polyisobutylene, urethane, polysiloxane, and polyacrylate.

4. The window seal of claim 1, wherein the diatomaceous earth comprises about 1–15 percent by weight of the seal.

5. The window seal of claim 4, wherein the diatomaceous earth comprises about 1–3 percent by weight of the seal.

6. A multi-pane window, comprising:

spaced, generally parallel, glass panes;

a polymeric seal disposed about the periphery of the panes, the seal establishing an airtight volume intermediate the panes, the seal evolving organic off-gases that have the tendency to migrate into the volume and condense on the panes; and a scavenger disposed within the seal for sorbing the off-gases, the scavenger consisting essentially of diatomaceous earth.

7. The window of claim 6, wherein the seal is selected from the group consisting of polyisoprene, polysulfide, polyisobutylene, and urethane.

8. The window of claim 6, wherein the panes are coated on the surfaces defining the volume with layers of iridium oxide, elemental silver, and a compound selected from the group consisting of iridium oxide, zinc oxide and titanium oxide.

9. The window of claim 8, wherein the layers coat the panes to a thickness of about 450 Å.

10. The window of claim 6, further comprising a spacer disposed intermediate the panes so as to space the panes a predetermined distance from each other.

11. The window of claim 10, wherein the spacer is made of a metal selected from the group consisting of aluminum and aluminum alloy.

12. The window of claim 10, wherein the spacer is hollow and includes an opening in communication with the volume, the scavenger being disposed within the spacer.

13. The window of claim 10, wherein the spacer is disposed within the seal.

14. The window of claim 13, wherein the scavenger constitutes about 1-15 percent by volume of the seal.

15. The window of claim 14, wherein the scavenger constitutes about 1-2 percent by volume of the seal.

16. The window of claim 13, wherein the scavenger is disposed uniformly throughout the seal.

17. A method for preventing fogging and discoloration of multi-pane windows, comprising:

spacing the panes to define a volume therebetween;

sealing the volume by means of a polymeric seal disposed about the periphery of the panes, the seal evolving organic off-gases that have the tendency to migrate into the volume; and sorbing the organic off-gases with a scavenger disposed within the seal.

18. The method of claim 17, wherein the seal is selected from the group consisting of polyisoprene, polysulfide, polyisobutylene, and urethane.

19. The method of claim 17, wherein the step of sorbing includes mixing diatomaceous earth within the seal in amounts effective to prevent or substantially reduce chemical fogging.

20. The method of claim 18, wherein the step of sorbing includes mixing within the seal diatomaceous earth in amounts such that the diatomaceous earth constitutes about 1-15 percent by weight of the seal.

21. The method of claim 18, wherein the step of sorbing includes mixing within the seal diatomaceous earth in amounts such that the diatomaceous earth constitutes about 1-3 percent by weight of the seal.

* * * * *